US005718660A

United States Patent [19]

Chen

[11] Patent Number: 5,718,660

[45] Date of Patent: Feb. 17, 1998

[54] EXERCISER FOR STRAIGHTENING SPINAL COLUMN

[75] Inventor: Paul Chen, Taichung, Taiwan

[73] Assignee: Jin Chen Chuang, Feng Yuan, Taiwan

[21] Appl. No.: 746,869

[22] Filed: Nov. 18, 1996

[51] Int. Cl.[6] ..... A61H 1/02; A61F 5/00

[52] U.S. Cl. ..... 482/144; 606/241; 482/96

[58] Field of Search ..... 482/95, 96, 131, 482/133, 139, 143, 144, 145, 907

[56] References Cited

U.S. PATENT DOCUMENTS

| | | | |
|---|---|---|---|
| 4,232,662 | 11/1980 | Barber | 482/144 |
| 4,419,989 | 12/1983 | Herbold | 482/144 |
| 4,531,731 | 7/1985 | Law | 482/144 |
| 5,044,358 | 9/1991 | Morin | 482/144 |
| 5,354,251 | 10/1994 | Steamaker | 482/96 |
| 5,551,937 | 9/1996 | Kwo | 482/144 |

FOREIGN PATENT DOCUMENTS

| | | | |
|---|---|---|---|
| 2194455 | 3/1988 | United Kingdom | 482/96 |

*Primary Examiner*—Richard J. Apley
*Assistant Examiner*—William LaMarca
*Attorney, Agent, or Firm*—Charles E. Baxley, Esq.

[57] ABSTRACT

An exerciser includes a base supported on a support in a suitable inclined angle for supporting a user. An extension is slidably engaged in the base and has one end extended outward of the base and has a clamping device for clamping the feet of the user to the extension. A bracket is secured to the extension. A lever is pivotally coupled to the base and a handle is secured to the lever for rotating the lever. A cable couples the lever to the bracket for moving the extension outward of the base and and for pulling the feet of the user so as to straighten the spinal column.

5 Claims, 4 Drawing Sheets

EXERCISER FOR STRAIGHTENING SPINAL COLUMN

BACKGROUND OF THE INVENTION

1. Field of the Invention

The present invention relates to an exerciser, and more particularly to an exerciser for straightening the spinal column of the user.

2. Description of the Prior Art

Typical exercisers may be used for exercising lower or upper muscle groups. None of the exercisers may be used for straightening the spinal column of the user.

The present invention has arisen to mitigate and/or obviate the afore-described disadvantages of the conventional exercisers.

SUMMARY OF THE INVENTION

The primary objective of the present invention is to provide an exerciser which can be used for straightening the spinal column of the user.

In accordance with one aspect of the invention, there is provided an exerciser comprising a support including an upper portion having a pivot shaft provided therein, a base including a middle portion pivotally coupled to the support at the pivot shaft for supporting a user, an extension slidably engaged in the base and including a first end portion extended outward of the base, means for supporting the base in an inclined status relative to the support, means for securing feet of the user to the first end portion of the extension, and means for moving the extension outward of the base for pulling the feet in a direction away from the user.

The supporting means includes a bar having an upper end pivotally coupled to the base and having a lower end, and the supporting means includes a tube having a lower portion pivotally coupled to the support and having an open upper end for slidably receiving the lower end of the bar, the tube includes a stop for engaging with the bar for supporting the base in the inclined status relative to the support.

An actuator is engaged between the base and the support for cushioning a relative movement between the base and the support.

The base includes a slot formed therein, the moving means includes a bracket secured to the extension and includes a fastener securing the bracket to the extension, the fastener is slidably engaged in the slot of the base for limiting a relative movement between the extension and the base, the moving means includes an actuating means for moving the extension outward of the base.

The actuating means includes a lever pivotally coupled to the base at a pivot pin, a handle secured to the lever for rotating the lever about the pivot pin, a pulley secured to the base distal to the lever, and a cable engaged around the pulley and having a first end secured to the bracket and having a second end secured to the lever for allowing the bracket to be moved by the cable when the lever is rotated by the handle.

The securing means includes a frame secured to the first end portion of the extension and having a foot support for engaging with the feet of the user, a sector gear secured to the frame, a casing having a lower portion pivotally coupled to the sector gear, a pawl pivotally engaged in the casing for engaging with the sector gear and for positioning the casing to the frame, and means for disengaging the pawl from the sector gear for allowing the casing to be rotated relative to the sector gear and for allowing the casing to move the foot support to engage with and to retain the feet of the user in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 5:
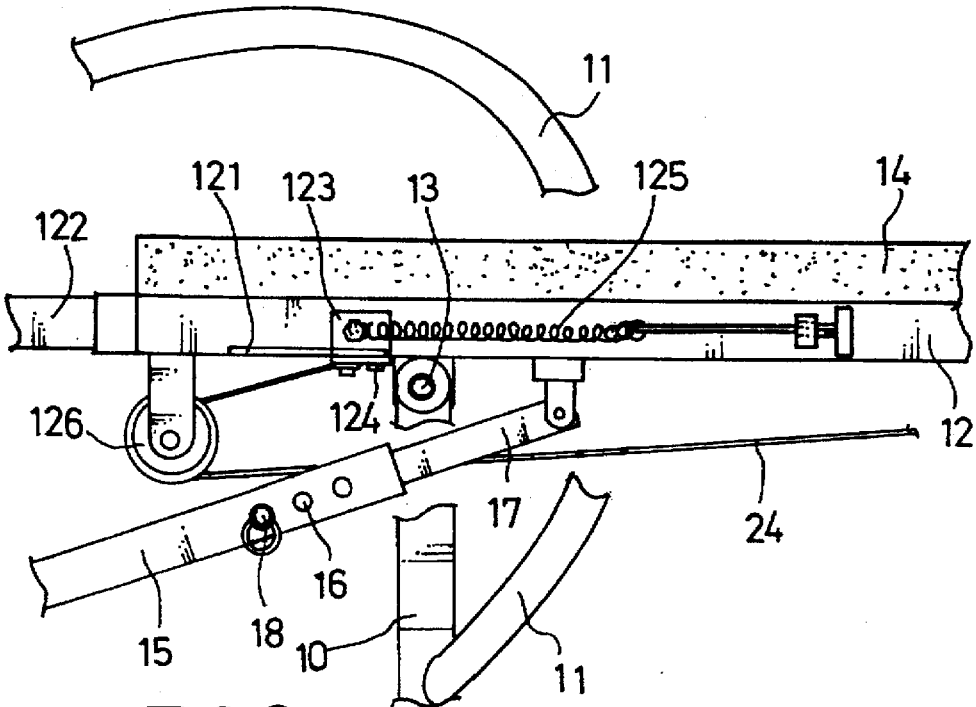
FIG. 5 is an enlarged partial side view of the exerciser.

Referring to the drawings, and initially to FIGS. 1 to 5, an exerciser in accordance with the present invention comprises a support 10 including a pair of hand grips 11 provided thereon. A tubular base 12 includes a middle portion pivotally supported on the support 10 at a pivot shaft 13 and includes a cushion 14 provided thereon for supporting the user. A tube 15 includes a lower portion pivotally coupled to the support 10 and includes an open upper end for slidably receiving a bar 17 (FIG. 5). The bar 17 includes an upper end pivotally coupled to the base 12. The tube 15 includes one or more holes 16 for engaging with a stop 18 which may engage with the bar 17 so as to limit the relative rotational movement of the base 12 relative to the support 10 and so as to support the base 12 and the cushion 14 at an inclined position, best shown in FIGS. 8 and 9. An actuator 19 (FIG. 1) is also engaged between the support 10 and the base 12 for cushioning the relative movement between the support 10 and the base 12 and for preventing the base 12 from impacting onto the support 10 or onto the supporting ground.

As best shown in FIG. 5, the tubular base 12 includes an extension 122 slidably engaged therein and includes a slot 121 formed therein. A bracket 123 is secured to the extension 122 by a bolt 124 which is engaged through the slot 121 of the base 12. The sliding engagement of the bolt 124 in the slot 121 may limit the relative sliding movement between the extension 122 and the base 12. A spring 125 couples the bracket 123 to the base 12 for pulling the extension 122 inward of the base 12. A pulley 126 is secured to the middle portion of the base 12 for engaging with a cable 24 which has one end secured to the bracket 123.

Figures 2, 3:
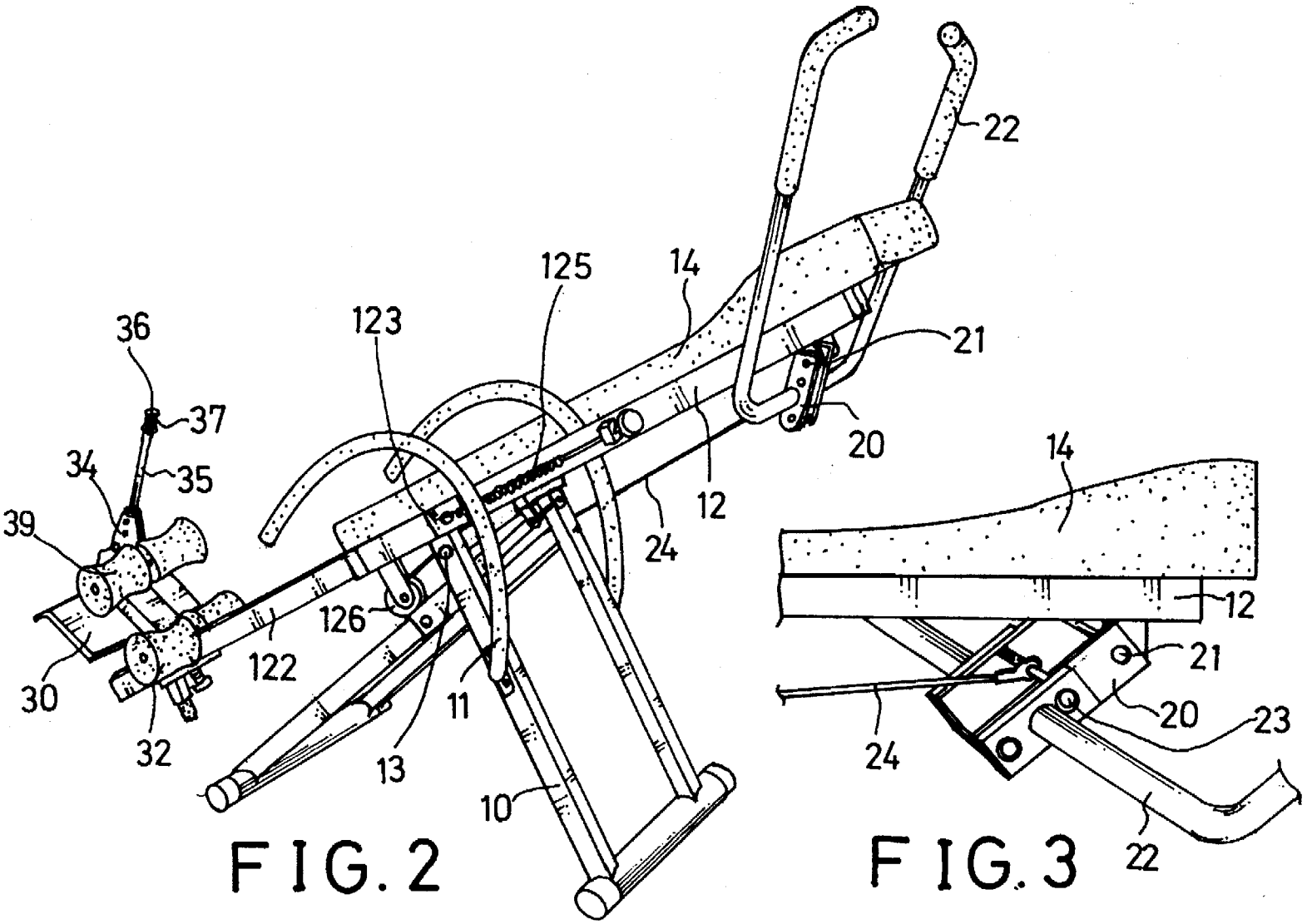
FIG. 2 is a rear perspective view of the exerciser.
FIG. 3 is an enlarged partial perspective view of the exerciser.
Figure 4:
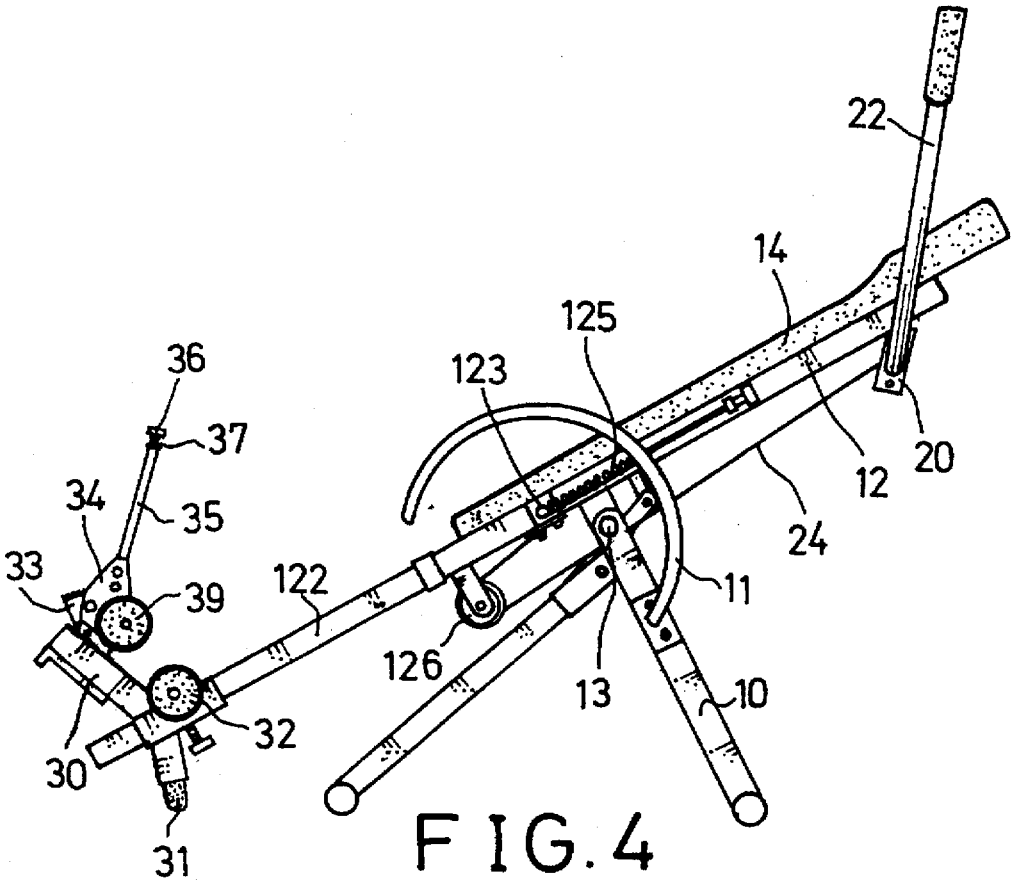
FIG. 4 is a side view of the exerciser.

As best shown in FIGS. 2 and 3, a lever 20 has an upper portion pivotally coupled to the base 12 at a pivot pin 21 and includes a pin 23 engaged in the middle portion for securing the other end of the cable 24. A pair of handles 22 have a lower portion secured to the bottom portion of the lever 20 for allowing the handles 22 to rotate the lever 20 about the pivot pin 21 and for pulling the extension 122 and the bracket 123 against the spring 125.

Figure 1:
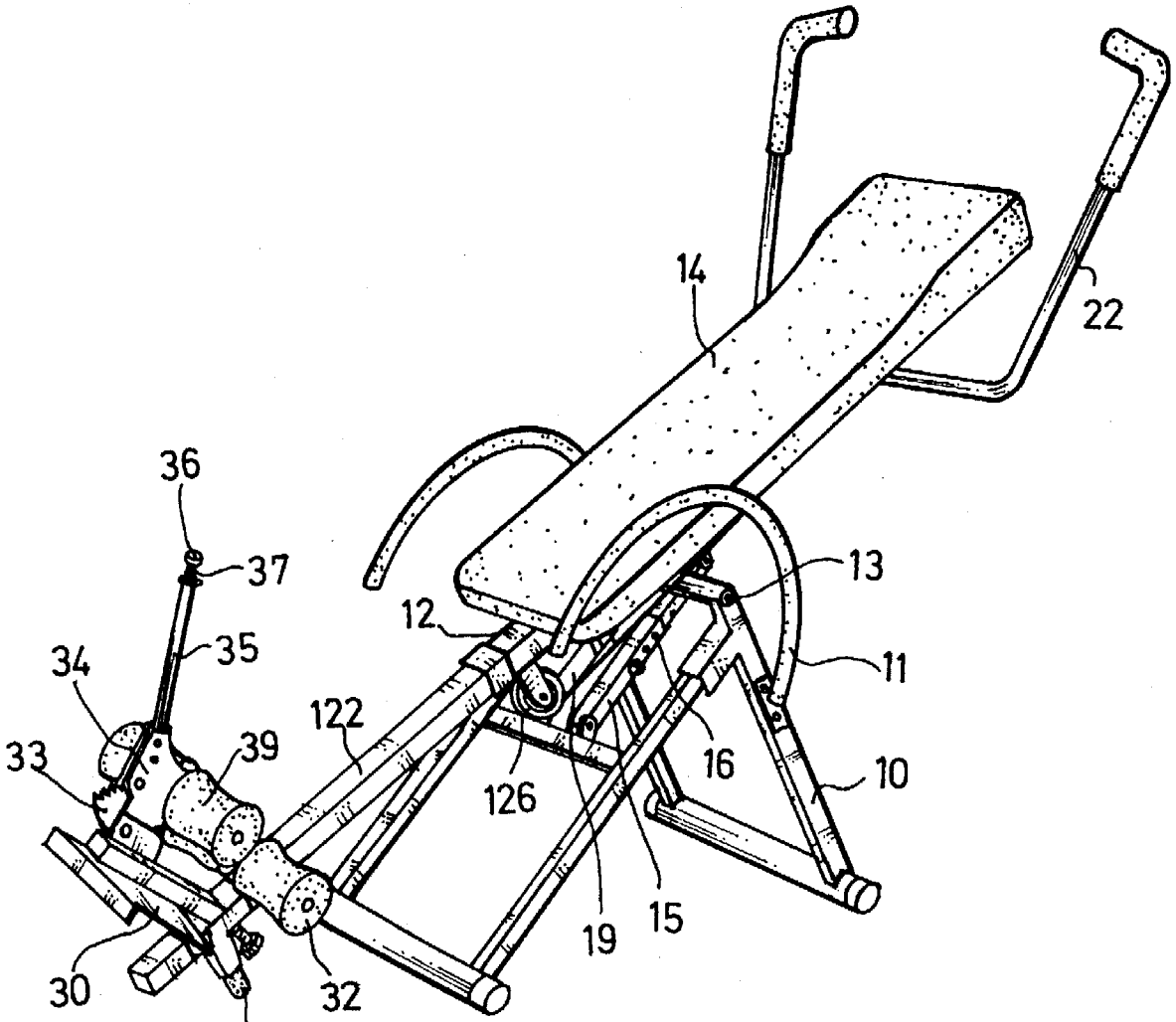
FIG. 1 is a front perspective view of an exerciser in accordance with the present invention.
Figure 7:
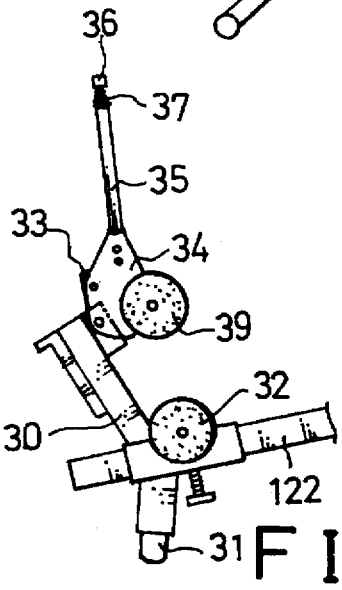
FIGS. 6 and 7 are enlarged partial side view illustrating the feet retaining means of the exerciser.
Figure 6:
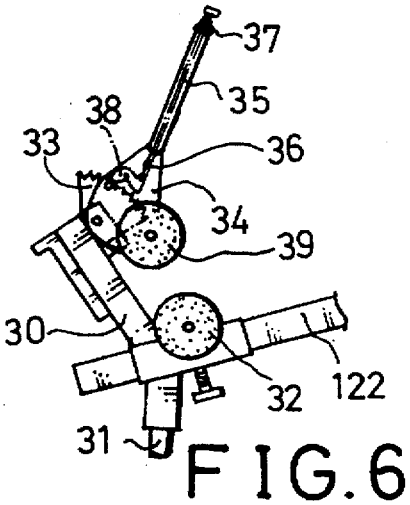

Referring next to FIGS. 6 and 7, and again to FIGS. 1 and 2, a frame 30 is secured to the free end of the extension 122 and includes a pad 31 for engaging with the supporting ground and includes a pair of lower foot supports 32 for supporting the feet of the user. A sector gear 33 is secured to the upper portion of the frame 30. A casing 34 is pivotally coupled to the lower portion of the frame 30 and includes a pipe 35 extended upward for slidably engaging with a rod 36 therein. A spring 37 is engaged between the upper end of the rod 36 and the pipe 35 for biasing the rod 36 upward. A pawl 38 is pivotally supported in the casing 34 for engaging with the sector gear 33 and for locking the casing 34 to the frame 30. The rod 36 may engage with the pawl 38 for disengaging the pawl 38 from the sector gear 33 and for allowing the casing 34 to be rotated relative to the sector gear 33 when the rod 36 is moved downward toward the pawl 38 against the spring 37. A further pair of foot supports 39 are secured to the casing 34 for engaging with and for retaining the feet of the user, together with the foot supports 32, when the casing 34 rotates toward the foot supports 32.

Figure 8:
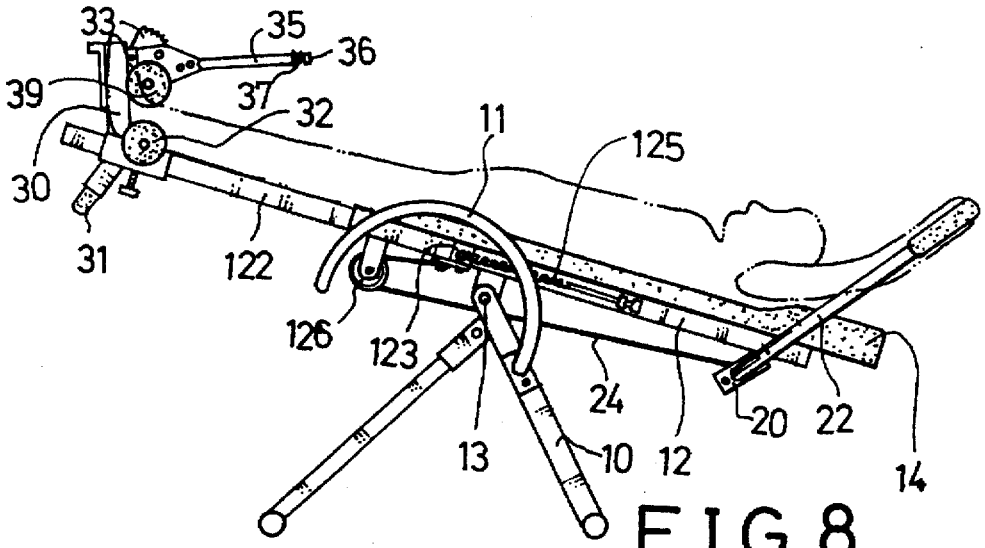
FIGS. 8 and 9 are side views illustrating the operation of the exerciser.
Figure 9:
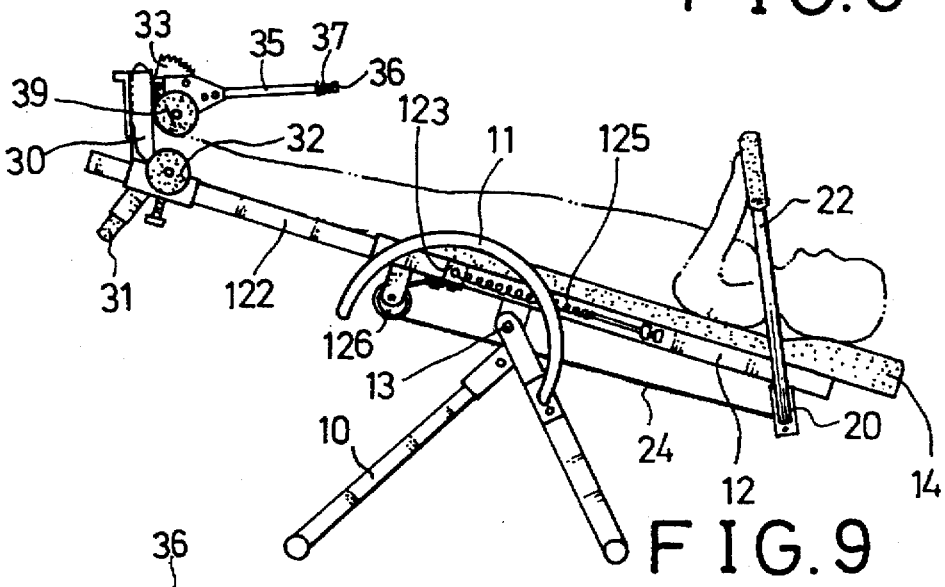

Referring next to FIG. 8, the base 12 and the cushion 14 may be supported in an inclined status by the engagement of the bar 17 with the stop 18 (FIG. 5) when the user lies on the cushion 14. The feet of the user may be retained in place by the feet supports 32, 39 when the frame 34 rotates toward the foot supports 32. When the handles 22 are rotated (FIG. 9) about the pivot pin 21 (FIG. 3) by the user, the extension 122 may be moved outward of the base 12 so as to pull the feet of the user, such that the user may conduct exercises and may straighten the spinal column of the user.

It is to be noted that the feet may also be pulled in the direction away from the user for straightening the spinal column without operating the handles 22 when the user is supported in an inclined status on the cushion 14, due to the weight of the user.

Accordingly, the exerciser in accordance with the present invention can be used for straightening the spinal column of the user and can be used for exercising purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a support including an upper portion having a pivot shaft provided therein, a base including a middle portion pivotally coupled to said support at said pivot shaft for supporting a user, an extension slidably engaged in said base and including a first end portion extended outward of said base, means for supporting said base in an inclined status relative to said support, means for securing feet of the user to said first end portion of said extension, and means for moving said extension and said foot securing means outward of said base to stretch said feet and for allowing said extension and said foot securing means to move backward to said base and for allowing said extension and said foot securing means to be moved in a reciprocating action relative to said base by said moving means.

2. An exerciser according to claim 1, wherein said supporting means includes a bar having an upper end pivotally coupled to said base and having a lower end, and said supporting means includes a tube having a lower portion pivotally coupled to said support and having an open upper end for slidably receiving said lower end of said bar, said tube includes a stop for engaging with said bar for supporting said base in the inclined status relative to said support.

3. An exerciser according to claim 1, wherein said base includes a slot formed therein, said moving means includes a bracket secured to said extension and includes a fastener securing said bracket to said extension, said fastener is slidably engaged in said slot of said base for limiting a relative movement between said extension and said base, said moving means includes an actuating means for moving said extension outward of said base.

4. An exerciser according to claim 3, wherein said actuating means includes a lever pivotally coupled to said base at a pivot pin, a handle secured to said lever for rotating said lever about said pivot pin, a pulley secured to said base distal to said lever, and a cable engaged around said pulley and having a first end secured to said bracket and having a second end secured to said lever for allowing said bracket to be moved by said cable when said lever is rotated by said handle.

5. An exerciser according to claim 1, wherein said foot securing means includes a frame secured to said first end portion of said extension and having a foot support for engaging with the feet of the user, a sector gear secured to said frame, a casing having a lower portion pivotally coupled to said sector gear, a pawl pivotally engaged in said casing for engaging with said sector gear and for positioning said casing to said frame, and means for disengaging said pawl from said sector gear for allowing said casing to be rotated relative to said sector gear and for allowing said casing to move said foot support to engage with and to retain the feet of the user in place.

* * * * *